US006659703B1

(12) United States Patent
Kirkley

(10) Patent No.: US 6,659,703 B1
(45) Date of Patent: Dec. 9, 2003

(54) STABILIZED SHIP-BORNE ACCESS APPARATUS AND CONTROL METHOD FOR THE SAME

(75) Inventor: David Kirkley, Cheam (GB)

(73) Assignee: Oceantech PLC

( * ) Notice: Subject to any disclaimer, the term of this patent is extended or adjusted under 35 U.S.C. 154(b) by 0 days.

(21) Appl. No.: 09/674,458

(22) PCT Filed: Apr. 27, 1999

(86) PCT No.: PCT/GB99/01304

§ 371 (c)(1),
(2), (4) Date: Oct. 30, 2000

(87) PCT Pub. No.: WO99/55579

PCT Pub. Date: Nov. 4, 1999

(30) Foreign Application Priority Data

Apr. 28, 1998 (GB) ..... 9809102

(51) Int. Cl.[7] ..... B66F 11/04

(52) U.S. Cl. ..... 414/139.7; 414/139.5; 414/139.6; 414/138.2; 414/138.3; 414/142.7

(58) Field of Search ..... 414/139.4, 139.5, 414/139.8, 142.6, 142.7, 139.6, 139.7, 138.2, 138.3

(56) References Cited

U.S. PATENT DOCUMENTS

| | | | | | |
|---|---|---|---|---|---|
| 844,477 | A | * | 2/1907 | Sieurin | 414/139.5 |
| 1,235,768 | A | * | 8/1917 | Cornbrooks | 414/139.5 |
| 2,512,477 | A | * | 6/1950 | Bowes | 414/139.5 |
| 2,522,466 | A | * | 9/1950 | Schneider | 414/139.5 |
| 2,876,919 | A | * | 3/1959 | True et al. | 414/139.5 |
| 3,675,794 | A | * | 7/1972 | Ingram et al. | 214/13 |
| 3,696,712 | A | | 10/1972 | Sung | |
| 3,794,187 | A | * | 2/1974 | Begault | 214/14 |
| 4,021,019 | A | * | 5/1977 | Sanders | 254/172 |
| 4,136,391 | A | * | 1/1979 | Eterno et al. | 364/478 |
| 4,215,851 | A | | 8/1980 | Holmen | |
| 4,236,686 | A | | 12/1980 | Barthelme et al. | |
| 4,317,524 | A | * | 3/1982 | Anderson | 414/138 |
| 4,373,332 | A | | 2/1983 | Holmen | |
| 4,395,178 | A | * | 7/1983 | Macdonell et al. | 414/139 |
| 4,632,622 | A | * | 12/1986 | Robinson | 414/138.2 |
| 4,854,800 | A | * | 8/1989 | Frick et al. | 414/138.2 |
| 4,932,541 | A | * | 6/1990 | Belsterling | 414/139.7 |
| 5,511,922 | A | * | 4/1996 | Sekiguchi et al. | 414/139.6 |
| 5,713,710 | A | * | 2/1998 | Strong et al. | 414/139.5 |

FOREIGN PATENT DOCUMENTS

| | | | | |
|---|---|---|---|---|
| DE | 2834483 | | 2/1980 | |
| EP | 0067669 | * | 10/1982 | 414/139.5 |
| EP | 0067669 | | 12/1982 | |
| EP | 0532096 A1 | * | 4/1992 | 414/139.5 |
| GB | 2163402 | | 2/1986 | |
| GB | 2267360 | | 12/1993 | |

* cited by examiner

*Primary Examiner*—Kathy Matecki
*Assistant Examiner*—Sang Kim
(74) *Attorney, Agent, or Firm*—Horst Kasper

(57) ABSTRACT

An apparatus for use on a vessel and for gaining access to a fixed structure such as a marine platform. As shown a supply vessel (1) has located on the deck (2) a mounting (3) which is connected by a gimbal arrangement (30) to a support arm (4) carrying a boom assembly (5) with a capsule (6) for personnel. The arm (4), boom (5) and capsule (6) are controlled in position by hydraulic means (9, 31, 33, 36, 40, 41, 52) to be manoeuvred into a required position to transfer personnel to the platform or decking (7) for example. In order to stabilise the position of the capsule (6) relative to the platform (7) the hydraulic means (9, 31, 33, 36, 40, 41, 52) is dynamically controlled to compensate for movement of the vessel (1) such that the capsule (6) will remain substantially in the selected spatial position relative to the platform (7). The capsule (6) may include a control system which enables an operator to statically position the capsule (6) through control of the overall systems. The mounting (3) on the deck (2) of a vessel (1) carries a gimbal structure (30) which supports the arm (4). The gimbal structure (30) is controlled in attitude by a series of rams (31). The arm (4) is mounted on the gimbal structure (30) to pivot about a transverse axis (43) and controlled by rams (40 and 41). The rams (40 and 41) thus control the tuffling of the arm (4). The arm (4) supports the boom (5) which may pivot around a transverse axis (50) controlled by a boom operating ram (52).

20 Claims, 8 Drawing Sheets

STABILIZED SHIP-BORNE ACCESS APPARATUS AND CONTROL METHOD FOR THE SAME

Figure 1:
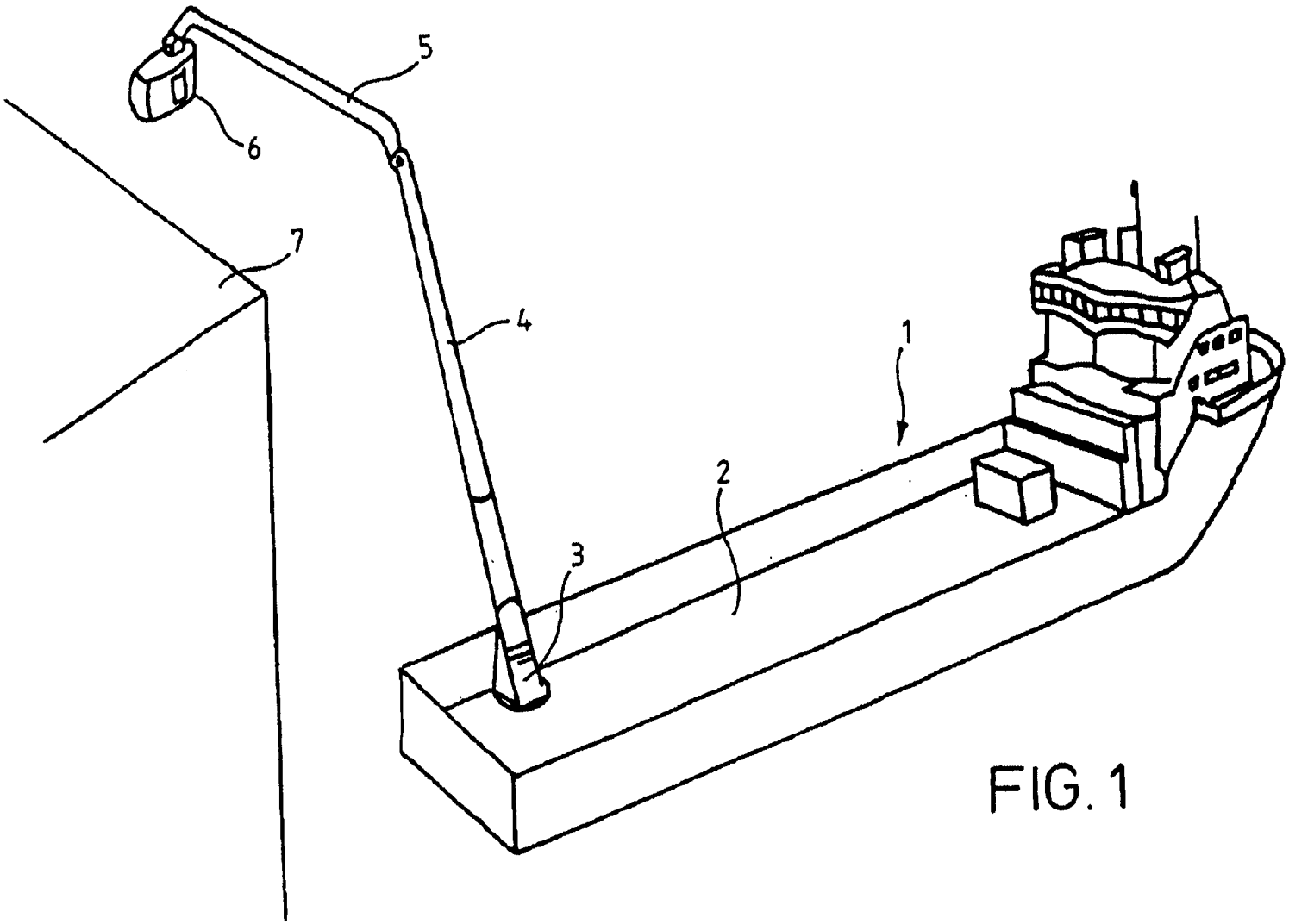

This invention relates to a stabilised access method and apparatus for use between two relatively moving structures to enable work to be performed or personnel to be transferred as well as equipment. In a particular preferred embodiment this invention is concerned with a stabilised working or transfer platform or capsule for personnel and is primarily intended for ship-borne use whereby the platform or capsule carried by a water-borne vessel remains substantially stationary in relation to a fixed structure which is to be accessed by the platform or capsule.

It has been proposed to provide a work platform mounted on an articulated arm assembly to provide access to a moving structure. In EP 0067669 such a device uses a clamp to connect the platform with the moving structure once it has been positioned. The device is intended to be used mounted on a fixed structure, such as a wharf, for work to be performed on a moving structure, such as a ship. This disclosure mentions a motion sensing means to effect adjustment of the platform but discards the idea as being too complicated, expensive and possibly unsafe.

It is one of the objects of this invention to provide an apparatus, preferably to be ship-borne, and by which a platform or transport capsule for personnel may be positioned relative to a fixed structure and thereafter spatially stabilised to avoid, or at least substantially reduce, relative motion.

Another object is to provide a method for control and stabilisation of an apparatus for such a purpose.

In accordance with one aspect of this invention there is provided an apparatus for providing access between a moving structure and a fixed structure, the apparatus comprising a base mounted on one structure, a support arm assembly mounted on the base with motional freedom in one or more planes or directions relative to the base, a carrier (such as a platform or support structure) mounted on the support arm, first means for control of the support arm to spatially position the support structure and carrier to a selected location and second means to subsequently effect adjustment of the support assembly to maintain the spatial position of the carrier at the selected location. In a preferred embodiment the support arm is pivotally mounted on the base, advantageously using a gimbal mount, and supports an articulated boom supporting the carrier, being a work platform or capsule, which may also be articulated to the boom. The support arm, boom and carrier are controlled, in a first phase by the first means to appropriately position the platform and in a second phase by the second means to compensate for movements of the base.

This invention also provides a method for the control of an access assembly including a carrier supported by a boom or arm and relatively adjustable with respect to a mounting to position the carrier to a selected location, characterised by a first control means to move and position the carrier spatially and a second control means to provide compensation movements to maintain the spatial position of the carrier following displacement of the mounting.

The first and second means may comprise hydraulic systems using independent actuators operating on a relevant pivot joint in parallel. The first actuator serving to position and counterbalance the assembly and hold a position with the second means providing compensating adjustment. The first means may include accumulators to permit movement relative to the held position. Thus positioning is effected by coarse control which can tolerate slow movement over large displacements, whilst compensation is effected by a fine control giving rapid response.

The system may also have only one actuator if both hydraulic control systems, that is the static positioning and dynamic compensation systems, are fed to the same actuator.

Hydraulic control is preferred and the means used may comprise actuators of various types such as piston and ram assemblies, rotary actuators hydraulic motors. Other systems such as electric actuators and drive means may be used.

The sensing system for maintaining the spatial position may comprise gyros and accelerometers, but optical, radio, electronic or mechanical systems referenced to a fixed or known location such as the sea-bed or the structure being accessed may be used as well as positional error corrected satellite positioning systems.

Figure 2:
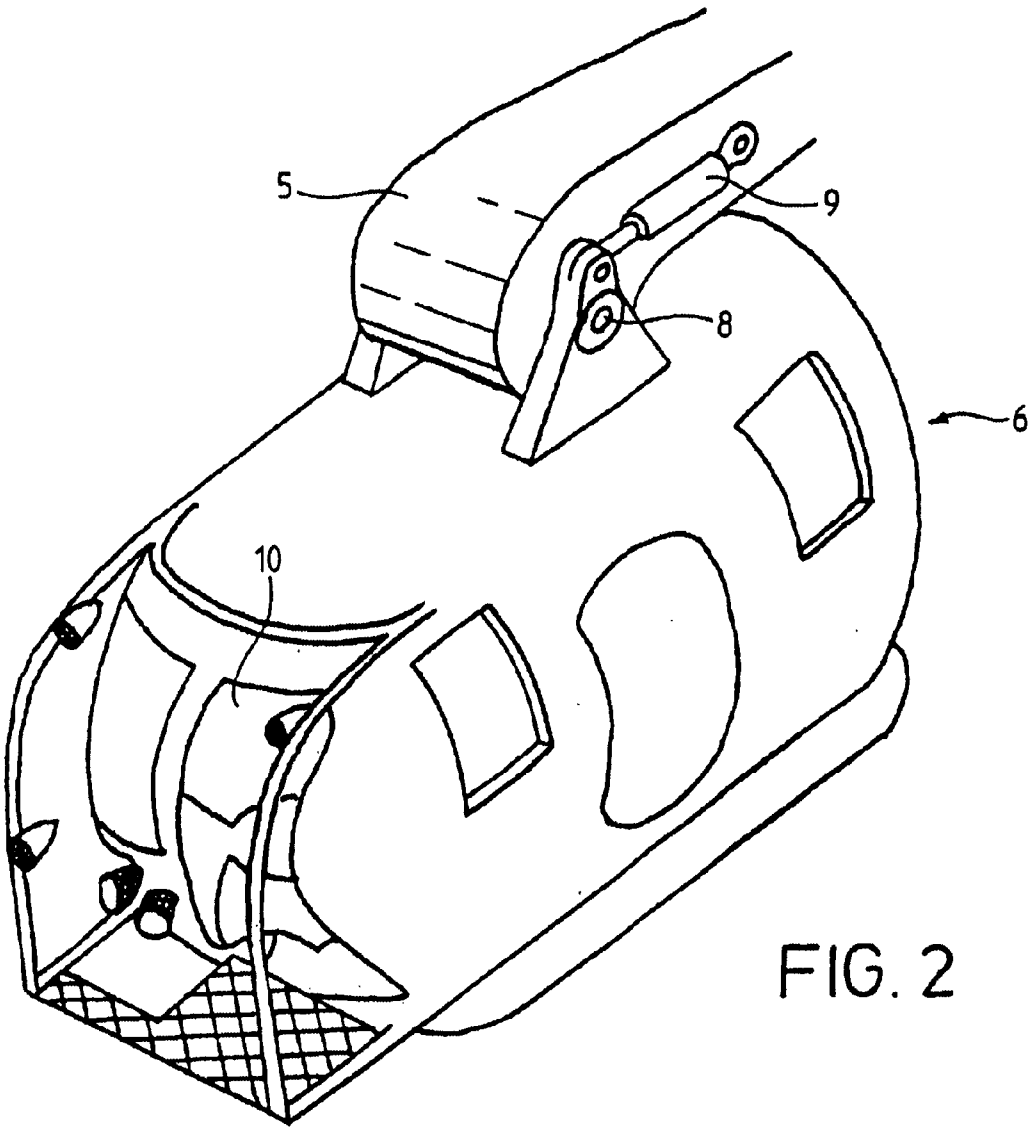
Figure 3:
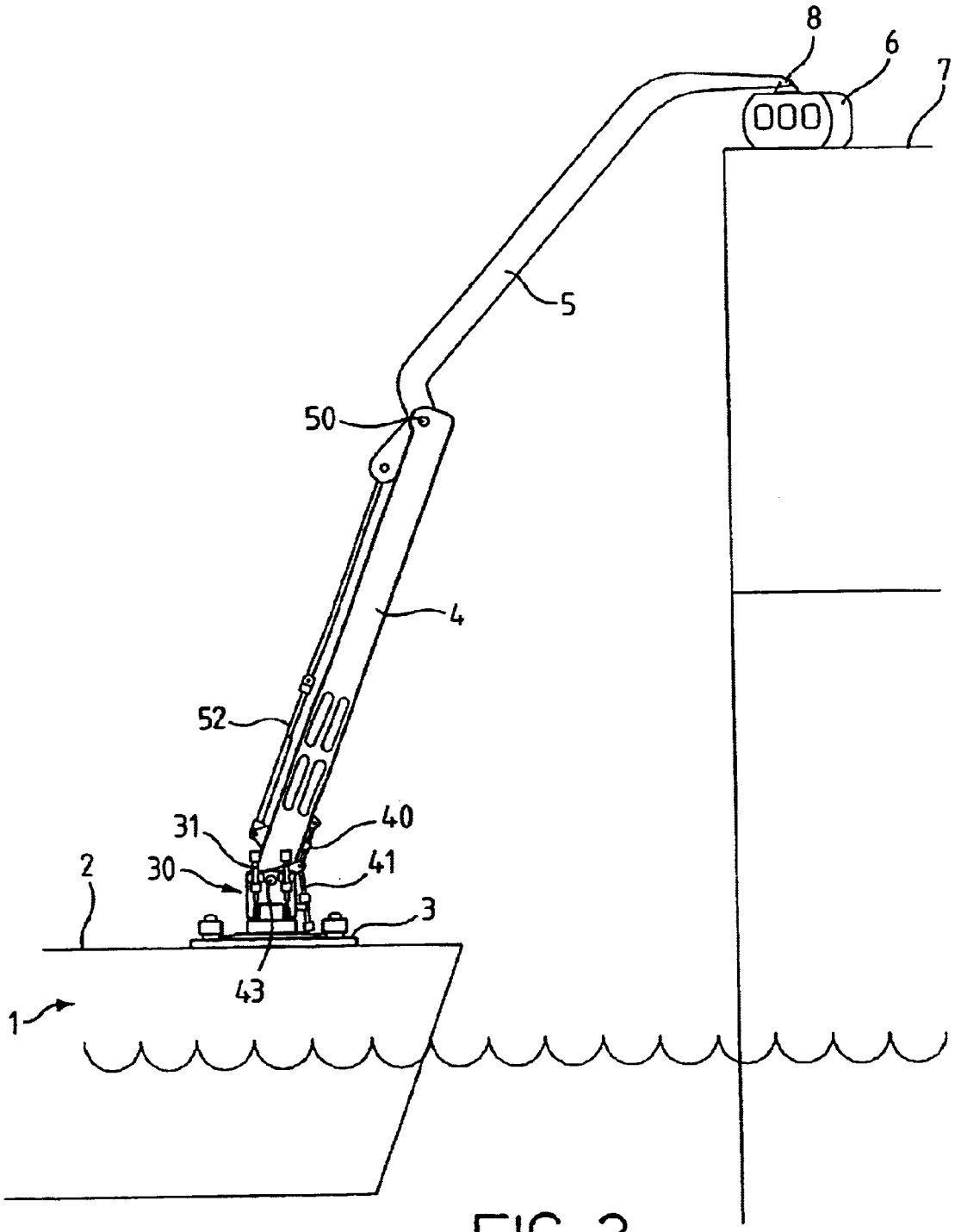
Figure 3A:
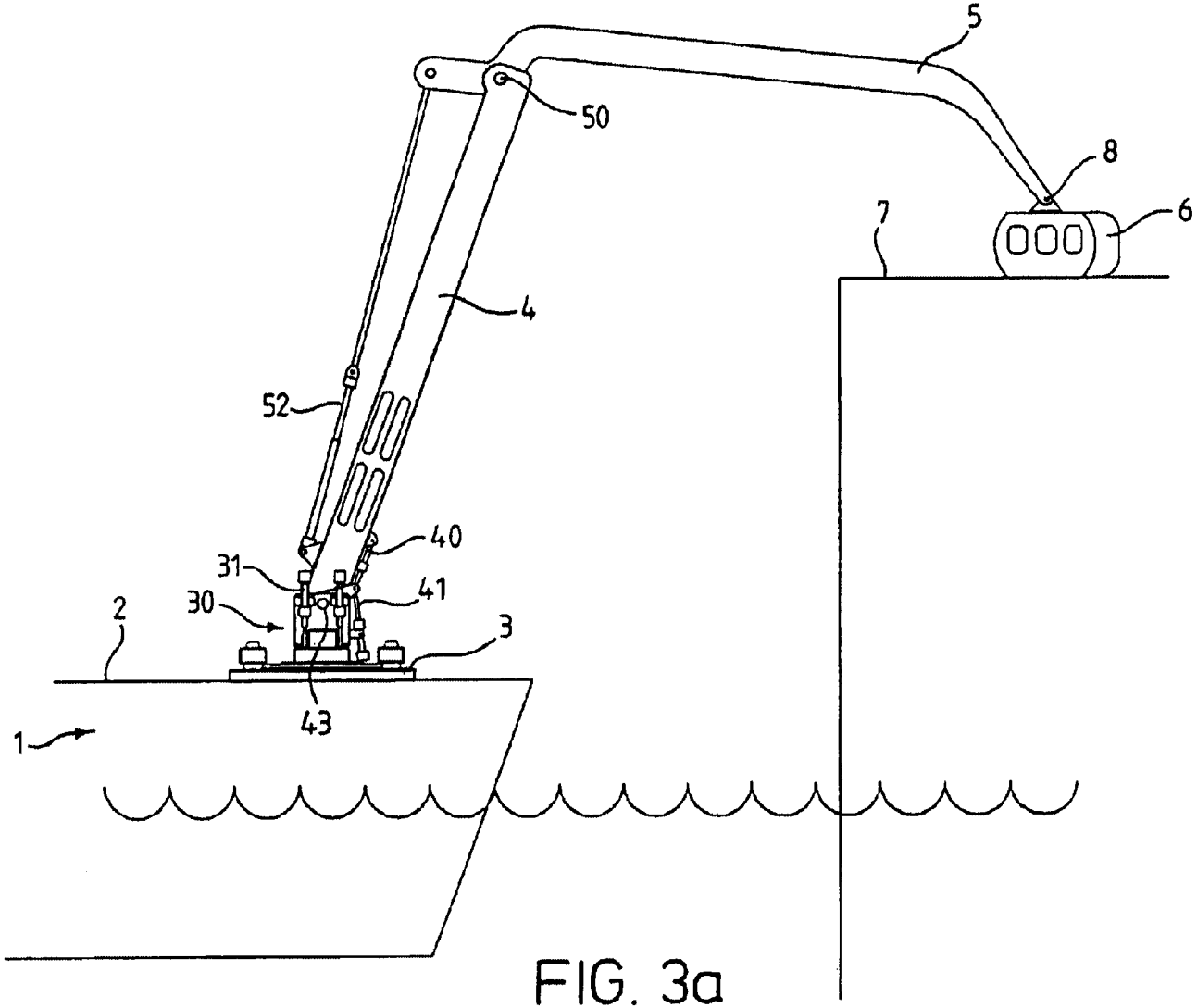
Figure 5:
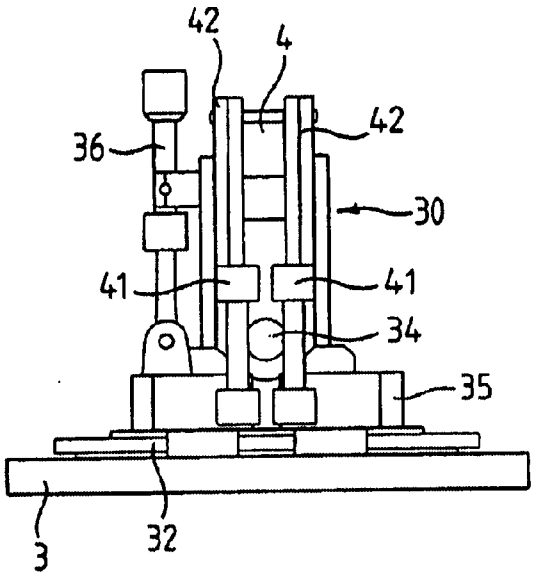
Figure 4:
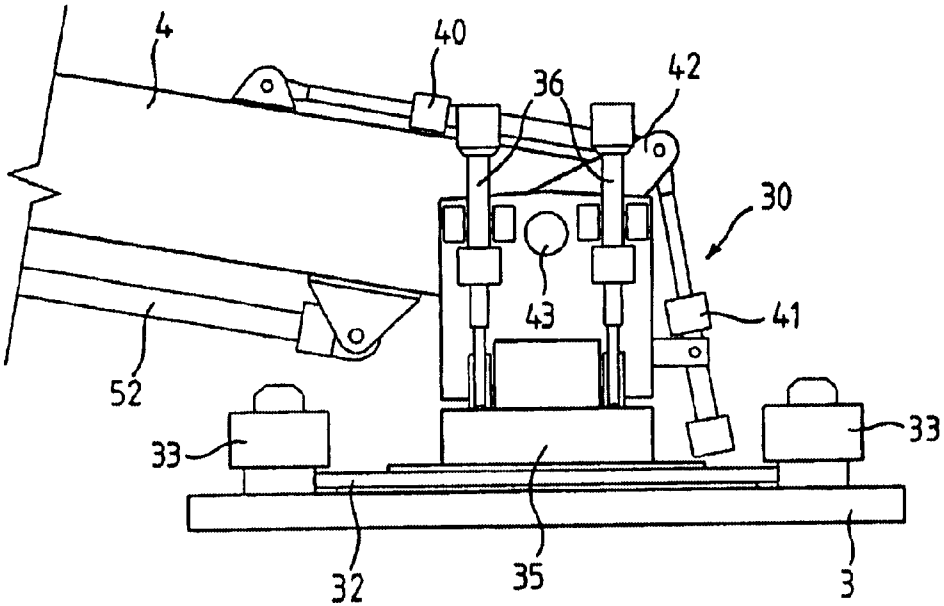
Figure 6:
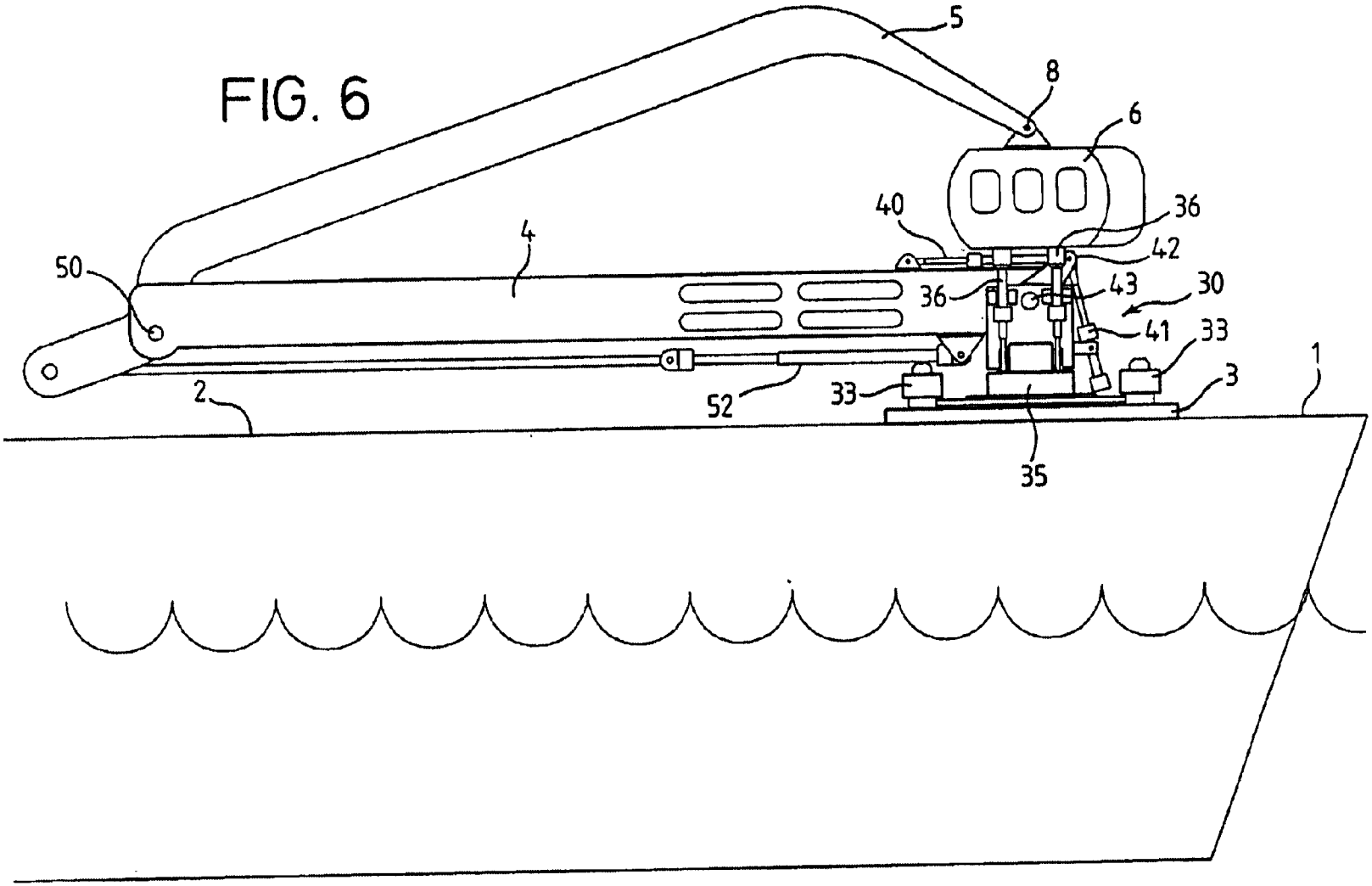
Figure 7:
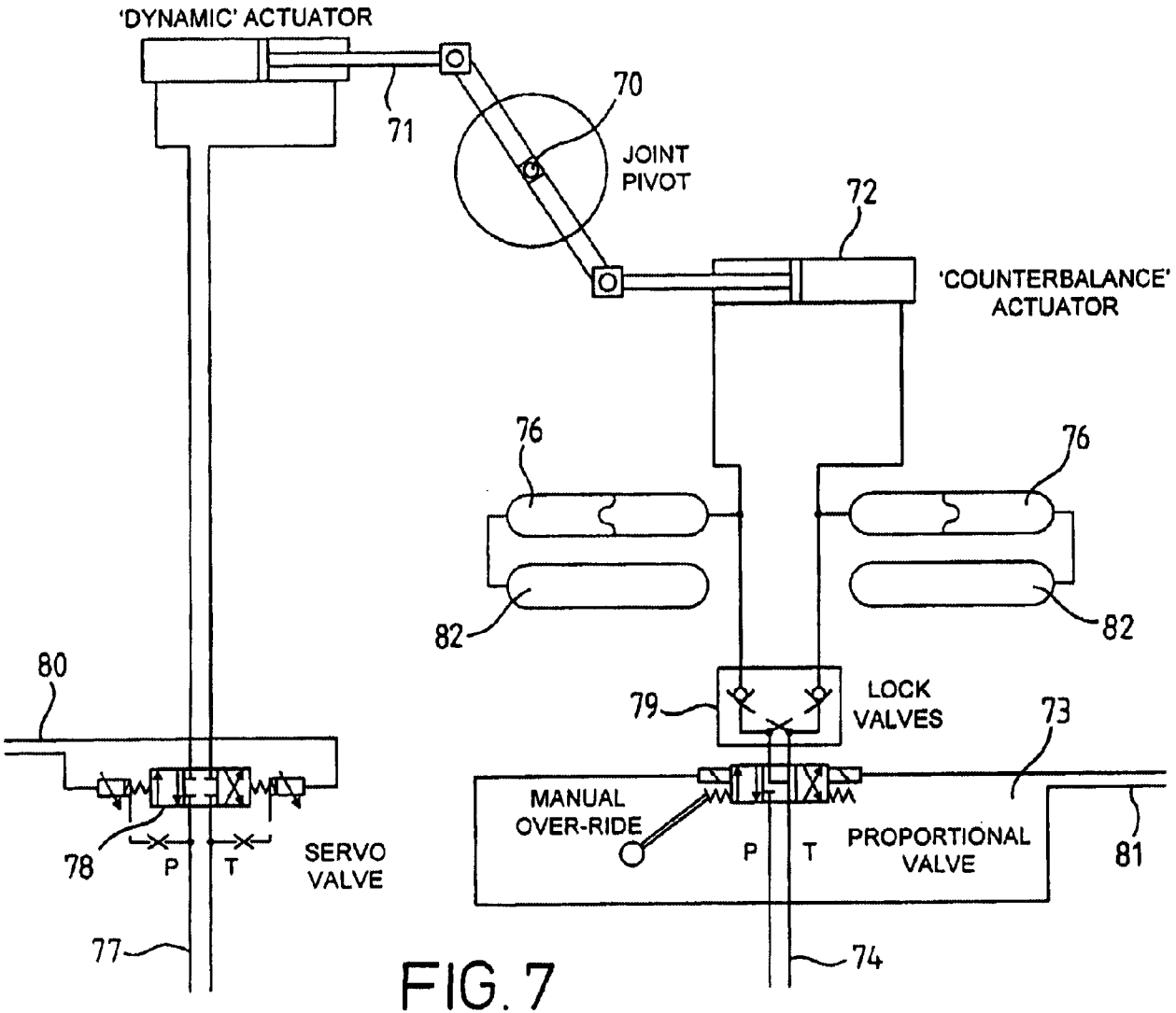

This invention will now be further described and illustrated with reference to the drawings showing preferred embodiments by way of example. In the drawings:

FIG. 1 shows a general view of an apparatus for transfer of personnel from a ship to a fixed structure, FIG. 2 shows a detail view of the capsule primarily for transfer of personnel FIGS. 3 and 3*a* show in more detail the support arm and boom assembly mounted on a vessel and in two positions, FIG. 4 shows the support arm mounting in detail and in side view, FIG. 5 shows the mounting of FIG. 4 in end view, FIG. 6 shows the apparatus stowed, and FIG. 7 shows schematically the hydraulic control system.

Figure 8:
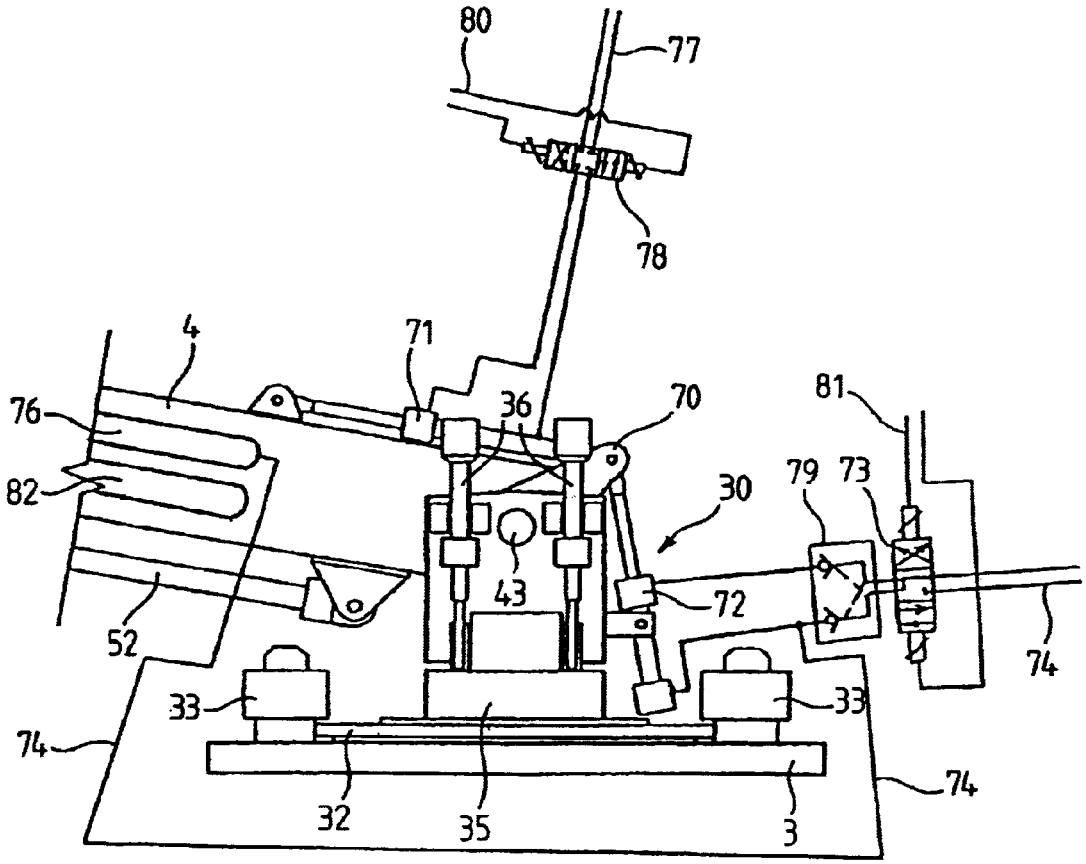

FIG. 8 shows the support arm mounting in relationship to hydraulic control system.

Referring firstly to FIG. 1 of the drawings there is shown the general arrangement of the access apparatus according to this invention as used on a vessel and for gaining access to a fixed structure such as a marine platform. As shown a supply vessel 1 has located on the deck 2 a mounting 3 which is connected by a gimbal arrangement to a support arm 4 carrying a boom assembly 5 with a capsule 6 for personnel. The arm 4, boom 5 and capsule 6 are controlled in position by hydraulic means to be manoeuvred into a required position to transfer personnel to the platform or decking 7 for example.

In order to stabilise the position of the capsule 6 relative to the platform 7 the hydraulic means is controlled to compensate for movement of the vessel 1 such that the capsule will remain substantially in the selected spatial position relative to the platform 7.

FIG. 2 shows the capsule 6 in more detail which is suspended on the boom 5 through pivot 8. A hydraulic ram forming a damper or positioning device 9 may be incorporated in order to control the attitude of the capsule 6. The capsule shown includes internal seating and an access door 10. The capsule may also include a control system which enables an operator to position the capsule through control of the overall system.

FIGS. 3 and 3*a* show the apparatus illustrating the working range of a typical example. As shown the mounting 3 on the deck 2 of a vessel carries a gimbal structure 30 which supports the ram 4. The gimbal structure 30 is controlled in attitude by a series of rams 31. The arm 4 is mounted on the gimbal structure 30 to pivot about a transverse axis 43 and controlled by a rams 40 and 41. The rams 40 and 41 thus control the luffing of the arm 4. The arm 4 supports the boom 5 which may pivot around a transverse axis 50 controlled by a boom operating ram 52.

The gimbal mounting structure 30 is shown in more detail in FIGS. 4 an 5. The gimbal structure 30 is carried on a turntable 32 driven by motors 33 and producing slewing of the assembly. The structure 30 is mounted through a pivot 34 (FIG. 5) on base 35 and is controlled in roll about this pivot by a ram assembly 36. As shown the arm 4 is controlled in luffing by rams 40 and 41 both acting on the lever arm extension 42. FIG. 6 shows the complete structure when retracted for transport.

Referring now to FIG. 7 of the drawings there is shown schematically and in simplified form a hydraulic operating arrangement for one typical pivot joint in the system. The pivot joint is represented by 70 and is actuated by two rams 71 and 72. The ram 72 controls positioning and counterbalance of the relevant arm 4 or boom 5 and positioning is effected through a control system 73, supplied with input signals 81 derived from an electronic control system, and feeding the rams from a hydraulic source 74. The arrangement uses hydraulic accumulators 76 which use gas pressurisation 82. The positional compensating for motion of the vessel to provide for constancy in the spatial position of the capsule 6 is achieved through the ram 71 fed from hydraulic supply 77 through a control valve system 78. The valve system 78 is controlled from an electronic sensor system 80 (not shown).

It is a feature of this invention to provide two independent systems, the one being arranged to provide positioning of the capsule by adjustment of the relevant parts of the apparatus and which requires substantial movement whilst the other is superimposed thereon and provides much more rapid response to compensate for movement of the whole apparatus.

The loads on the structure are imposed by two mechanisms, the weight of the components and the dynamic loading due to ships motion.

The self-weight loads are very large compared to the dynamic loads but change only slowly as the structure is deployed. The dynamic loads, although smaller, impose the highest power requirements due to their much higher rate of change and therefore speed of movement.

To attempt to fulfil both requirements using a single set of actuators on each joint would result in a very large power requirement. Both high loads and high speeds would be required of the actuator.

To avoid this, and in accordance with this invention, the joints subject to high self-weight induced forces, such as the shoulder and elbow joints, are preferably fitted with two sets of actuators. One set of actuators will support the self-weight of the structure and provides the movements required for the deployment of the arm, while the other set provides the dynamic movement to maintain position as the ship moves.

The sets of actuators act in parallel and are both capable of movement through the whole range of travel of the joints.

In an alternative arrangement only one actuator is provided and both hydraulic control systems are fed to this actuator. In FIG. 7 the counterbalance actuator acts as a spring once the lock valves 79 are closed. The same result can be achieved if the hydraulic lines from the servo valve 78 are fed directly to the counterbalance actuator. The dynamic actuator 71 and the pivot 70 can then be dispensed with. Two actuators would be desirable for redundancy purposes.

The counterbalance system provides support of the self-weight and deployment of the arm. It has been assumed that the arm is deployed within five minutes from stowed. The power to achieve this is very low and only small hydraulic flows are required. Once the counterbalance actuator has moved the arm to the required position, lock valves 79 (FIG. 7) prevent further large movements or collapse in case of system failure.

The dynamic system requires moving the arm to counteract ship's motion, even though the joint is locked by the counterbalance system. To achieve this an accumulator is employed between the lock valves and the actuator. The gas volume of the accumulator is sufficient to allow the dynamic system to move the joint without large pressure variations in the counterbalance actuator. Damping in the accumulator system aids the dynamic system to control the joint movement smoothly. The operator controls the position of the arm by control of the counterbalance system.

The dynamic system acts on the joints to counteract vessel motion and maintain the remote end of the arm steady in space.

Outputs from sensor are conditioned to drive the dynamic control valve as required. This servo-valve with a high frequency response allows it to accept the rapidly changing inputs. The servo-valve controls an actuator in parallel with the counterbalance actuator to move the point in small amounts in response to ship's motion.

The counterbalance system has sufficient gas damping volume to allow the dynamic actuator to operate within its normal range without meeting excessive resistance from the counterbalance actuator. However, if the dynamic system fails and the actuator attempts to perform a very large movement it will be opposed by the counterbalance system and/or the arm weight an it will stall.

This interaction between the dynamic and counterbalance system therefore provides a fail-safe system.

The control system has three layers. The first layer controls the position of an individual joint using a local joint-controller. The second layer commands all the joints, concentrating the data commands coming from the third layer's coordinator and the local joint-controller. The third layer takes command input from the operator and the attitude sensor data and resolves these into arm motion commands passing the data and commands to the second layer.

The local joint-controllers are digital controllers, programmed to implement an extended proportional, integral and derivative (PID) controller. As the geometry of the arm changes during deployment, the control characteristics change. Digital controllers are configured to allow for the differing control parameters. The local joint-controllers allow updating of the control parameters dynamically in real time. This enables an adaptive controller to be readily implemented and allows full optimisation of the control system throughout the operating envelope.

The use of individual joint-controllers which are self-contained means that failure of one controller does not affect the other joints, and the higher layers of the control system can compensate in part for the missing function. This will improve the safety of the system.

The local joint-control function has the following features:

Demand limit function:
- to limit the rate that the system will respond to a sudden change of dement.

Velocity feed forward:
- used to reduce or remove error when following a changing demand.

Proportional, integral and derivative (PID):
- to control the stability and performance of the system.

Pressure feed back:
- to damp the system.

Velocity feed back:
- used in conjunction with velocity feed forward to control the response of the system to demand changes.

The control parameters and demand input to the controllers can be updated 50 times a second. The internal sample rate is 100 Hz and thus the controllers are capable of working with systems of up to about 10 Hz bandwidth. The parameters can be updated while actuation is taking place. Hence, as the arm extends and the inertia and loads change, the parameters can be altered. This allows the control function to be changed for optimum performance through the operating range.

The local joint-controllers are connected to the second layer of the overall control system. This second layer is the arm controller. This unit acts as a data concentrator. Commands from the top-level controller are passed through this device to the relevant local joint-controller. Data coming from the local joint-controllers is passed back to the top-level controller. This unit is based on microprocessors. One is used for the data communications: a second to resolve the commands for the arm into individual joint demands. The arm position demands will be in the form of x, y, z, a, b, c, (six degrees of freedom: three translations and three rotations) where the translations will refer to the position of the cabin (the end of the boom) and the rotations will be about the base of the arm.

The overall control unit takes information coming from the attitude sensors (fitted to or on the arm base) and mixes these with operator input commands. The attitude sensors provide roll, pitch and heading information, along with triaxial accelerometer outputs in x, y, and z. These are resolved into ship's/world co-ordinates as required and then band-pass filtered. The band-pass filtered outputs are double-integrated to provide the instantaneous position of the arm base and its orientation to the horizon. These values are inverted and added to the demand position of the arm tip. The effect of this is to leave the arm tip stationary (control system errors excepted). The overall control unit reads the operator controls and processes them. Pertinent information is sent to the operator's display. A second attitude sensor pack fitted to the arm tip would be used to help improve control performance and could provide back up to the arm-base system in the event of failure. The attitude sensors are based on a vertical-reference gyro and triaxial accelerometer set. In addition a heading gyrocompass (north referenced) provides yaw data.

In a further arrangement feedback may be provided from a sensor which measures the distance from the target landing area of the capsule. This may be achieved mechanically using a sensing wand or by the weight change of a flexible member such as a chain which touches the landing site. Other propose methods use optical, radio or acoustic devices.

It can be important to avoid the capsule landing on the target and thus ceasing to be dynamic. This can be achieved by ensuring that the capsule is controlled in such a way as to hover over the target zone by using some form of proximity sensor such as described above. The same object can be achieved by the capsule pilot having manual control and indeed this is desirable as the pilot should be able to drive the capsule from the stowed position to the target zone.

In an advantageous version software used to control the stabilisation will include predictive elements based on algorithms or past movements.

What is claimed is:

1. An apparatus for providing access between a moving structure and a fixed structure, the apparatus comprising a base with a fixed part to be mounted, when in use, on the moving structure and an articulated part for controlled movement in three mutually perpendicular planes or directions relative to the fixed part of the base, a support arm assembly mounted at one end on the articulated part of the base for luffing and reach movement, a carrier mounted on the other end of the support arm, first drive means for control of the movement of the support arm assembly and the articulated part of the base to spatially position the carrier to a selected location relative to the fixed structure and second drive means to effect adjustment of the articulated part of the base and the support arm assembly relative to the moving structure to maintain the spatial position of the carrier at the selected location.

2. Apparatus in accordance with claim 1, wherein the support arm is pivotally mounted on the articulated part of the base and supports an articulated boom to which the carrier, comprising a work platform or capsule is articulated, the articulated part of the base being mounted on the fixed part of the base using a three axis gimbal mount.

3. Apparatus in accordance with claim 1 or 2, wherein the support arm, boom and carrier are adjusted, in a first phase by the first drive means to statically position the carrier to the selected location and in a second phase by the second drive means to dynamically compensate for movements of the moving structure to maintain said location.

4. Apparatus in accordance with claim 1, wherein the first and second drive means comprise hydraulic systems using independent actuators operating about a relevant pivot joint, a first system serving to position and counterbalance the assembly to a defined spatial position with the second actuator providing compensating adjustment to hold said position.

5. Apparatus in accordance with claim 4, wherein the first means may include accumulators to permit movement relative to the selected location position.

6. Apparatus in accordance with claim 1, wherein the first and second drive means comprise hydraulic systems using a common actuator operating on a relevant pivot joint, the actuator being controlled to both position and counterbalance the assembly and hold a position providing compensating adjustment.

7. Apparatus in accordance with claim 6, wherein hydraulic control is used comprising actuators such as piston and ram assemblies and rotary actuators or hydraulic motors.

8. Apparatus in accordance with claim 1, wherein the sensing system for maintaining the spatial position comprises gyroscopic means, accelerometers, optical, wireless, electronic or mechanical systems referenced to a fixed or known location.

9. An apparatus for use on a floating vessel and for gaining access to a fixed structure, the apparatus comprising a fixed vessel deck mounting base which supports through a three axes gimballed arrangement and a pivot assembly, a support arm carrying an articulated boom assembly with a capsule or platform for personnel or equipment, the base, arm, boom and capsule being controlled in position by hydraulic drive means, so as to be manoeuvrable into a required static position relative to the fixed structure, the position of the capsule or platform relative to the vessel deck being stabilized, using the drive means, and dynamically controlled to compensate for movement of the vessel such that the capsule or platform remains substantially in the selected spatial position relative to the fixed structure.

10. Apparatus in accordance with claim 9, wherein the capsule includes a control system which enables an operator to statically position the capsule through control of the overall system.

11. Apparatus in accordance with claim 9 or 10, wherein the mounting on the deck of a vessel carries a gimbal structure which supports the arm, the gimbal structure being controlled in attitude by a series of hydraulic rams, the arm being mounted on the gimbal structure to pivot about a transverse axis and controlled by said rams, said rams effecting control of the luffing of the arm, the arm supporting the boom being capable of pivoting around a transverse axis controlled by a boom operating ram.

12. Apparatus in accordance with claim 9, wherein the carrier or capsule includes a proximity sensing device to maintain a substantially constant distance between the capsule and the fixed structure.

13. A method for providing access between a moving structure and a fixed structure, using a base assembly mounted on the moving structure and with controlled movement in or about three mutually perpendicular planes or axes, a support arm assembly articulated on the base assembly for luffing and reach movement, and a carrier mounted on the other end of the support arm, the method using a first drive means for control of the movement of the base assembly and the support arm assembly to spatially position the carrier to a selected location relative to a fixed structure and second drive means to superimpose movement on the first drive means to effect adjustment of the base and the support arm assembly relative to the moving structure to maintain the selected spatial position of the carrier.

14. A method for providing access between a moving structure and a fixed structure comprising mounting a base assembly on a moving structure;

controlling movement of the base assembly in or about three mutually perpendicular planes or axes;

disposing a support grin assembly articulated on the base assembly for luffing and reach movement;

mounting a carrier on the other end of the support arm;

controlling the movement of the base assembly and the support arm assembly using a first drive means to spatially position the carrier to a selected location relative to a fixed structure;

superimposing movement on the first drive means with a second drive means to effect adjustment of the base and the support arm assembly relative to the moving structure to maintain the selected spatial position of the carrier.

15. An apparatus for providing access between a moving structure and a fixed structure comprising a fixed part mounted on the moving structure;

a motor (33) mounted on the fixed part;

a turntable (32) driven by the motor; a base element (35) mounted on the turntable (32), wherein the turntable (32) and the base element (35) are turnable horizontally around 360 degrees;

a ram assembly (36);

rams (31);

a three axis gimbals mount (30) wherein the three axis gimbals mount is controlled in attitude by rams (31);

a gimbals mount pivot (34) connecting the base element (35) to three axis gimbals mount (30), wherein the three axis gimbals mount keeps horizontal level of the articulated part irrespective of the moving structure motion, and wherein three axis gimbals mount is controlled to roll about the gimbals mount pivot (34) by the ram assembly (36), wherein the ram assembly (36), rams (31), the three axis gimbals mount (30) and the gimbals mount pivot (34) form an articulated part;

a support arm assembly (4) pivotally mounted on the articulated part of the base through a support arm transverse axis (43), wherein support arm assembly comprises the lever arm extension (42, 70) turnable around the support arm transverse axis (43), a boom (5) pivotably mounted on the other end of the support arm through a boom transverse axis (50), a carrier (6) pivotably mounted on the other end of the boom through a carrier pivot (8), comprising a work platform or capsule and positioning to selected location relative to the fixed structure, first drive means for control of the movement of the support arm assembly and the articulated part of the base to spatially position the carrier to a selected location relative to the fixed structure and to counterbalance of the support arm assembly and the articulated part of the base against the self-weight loads, and second drive means to effect adjustment of the support arm assembly and the articulated part of the base relative to the moving structure to maintain the spatial position of the carrier (6) at the selected location against the dynamical loads due to the moving structure motion.

16. Apparatus in accordance with claim 15, wherein the first and second drive means comprise hydraulic systems using independent actuators operating about the lever arm extension (42, 70), a first system serving to position and counterbalance the support arm assembly to a defined spatial position of the carrier (6) with the second actuator providing compensating adjustment to hold said position of the carrier (6).

17. Apparatus in accordance with claim 14, wherein the first drive means comprise an actuator (41, 72) for position and counterbalance of the support arm assembly (4) wherein one end of the actuator (41, 72) is attached to the three axis gimbals mount and the other end of the actuator (41, 72) is attached to the lever arm extension (42, 70) of the support arm assembly (4), a boom operating ram (52) for positioning and counterbalancing of the boom (5), wherein one end of the boom operating ram (52) is attached to the support arm assembly (4) and the other end of the boom operating ram (52) is attached to the boom (5) so that boom (5) is pivoted around the boom transverse axis (50), a hydraulic ram (9) for positioning and counterbalancing of the carrier (6), wherein one end of the hydraulic ram (9) is attached to the boom (5) and the other end of the hydraulic ram (9) is attached to the carrier (6) so that carrier (6) is pivoted around the carrier pivot (8), a control system (73) for positioning and counterbalancing controlling comprising a proportional valve controlled by an input automatical signal (81) derived from an electronic control system, with manual over-ride, and feeding the actuator from the hydraulic source (74).

18. Apparatus in accordance with claim 16, wherein the second drive means comprise an actuator (40, 71) to dynamically compensate for movements of the moving structure to hold the carrier (6) in the said location, wherein one end of the actuator (40, 71) is attached to the support arm assembly (4) and the other end of the actuator (40, 71) is attached to the lever arm extension (42) of the support arm assembly (4), a control valve system (78) for dynamical compensation controlling comprising a servo valve controlled by an electronic sensor system (80), and feeding the actuator (40, 71) from the hydraulic source (77).

19. Apparatus in accordance with claim 15, wherein the first and second drive means comprise hydraulic systems including a common actuator (41) with lock valves (79) operating on the lever arm extension (42, 70), the actuator (41) being controlled to both position and counterbalance the support arm assembly (4) and to hold a position of the carrier (6) providing dynamical compensating adjustment.

20. Apparatus in accordance with claim 19, wherein actuator (41, 72) provides both positioning and counterbalancing, when the lock valves (79) are opened, and provides dynamical compensating adjustment when the lock valves (79) are closed.

* * * * *